United States Patent [19]

Beck et al.

[11] Patent Number: 4,638,916

[45] Date of Patent: Jan. 27, 1987

[54] CLOSURE WITH SNAP-TYPE HINGE CAP

[75] Inventors: James M. Beck, Carol Stream; Robert D. Rohr, Elgin, both of Ill.

[73] Assignee: Owens-Illinois, Inc., Toledo, Ohio

[21] Appl. No.: 754,796

[22] Filed: Jul. 12, 1985

[51] Int. Cl.[4] ..... B65D 43/14

[52] U.S. Cl. ..... 215/235; 222/517

[58] Field of Search ..... 222/498, 517; 215/235, 215/237; 220/339, 335

[56] References Cited

U.S. PATENT DOCUMENTS

| | | | |
|---|---|---|---|
| 3,227,332 | 1/1966 | Gowdy et al. | 222/498 X |
| 3,289,877 | 12/1966 | Wolf . | |
| 3,629,901 | 12/1971 | Wolf . | |
| 3,741,447 | 6/1973 | Miles et al. | 222/498 X |
| 3,933,271 | 1/1976 | McGhie | 222/498 X |
| 4,022,352 | 5/1977 | Pehr | 222/546 |
| 4,124,151 | 11/1978 | Hazard | 222/498 |
| 4,220,248 | 9/1980 | Wilson et al. | 215/235 |
| 4,291,818 | 9/1981 | Nozawa et al. | 222/498 X |
| 4,386,714 | 6/1983 | Roberto et al. | 220/335 X |
| 4,545,495 | 10/1985 | Kinsley | 215/235 |

FOREIGN PATENT DOCUMENTS 1056999 12/1964 United Kingdom .

*Primary Examiner*—Donald F. Norton

*Attorney, Agent, or Firm*—John R. Nelson

[57] ABSTRACT

A closure with a snap type hinge cap comprising a first part adapted to interengage with the open neck of a container, a second part forming a cap and an integral hinge interconnecting the first and second parts. Each of the first and second parts comprises a base wall and a peripheral skirt. A pair of hinge straps extends from the skirts and are positioned on opposite sides of the integral hinge. The radial length of the pair of hinge straps is less than the length of the arc through which the second cap part moves to and from and closed position relative to the first part such that the pair of straps stretch to function as springs. The ends of the pair of straps are attached to the skirts radially inwardly of the periphery of the skirts.

8 Claims, 7 Drawing Figures

CLOSURE WITH SNAP-TYPE HINGE CAP

This invention relates to closures and particularly to closures of the type which include a cap that is connected to the remainder of the closure by an integral hinge.

BACKGROUND AND SUMMARY OF THE INVENTION

It has heretofore been proposed that closures be provided for containers wherein the closures include a cap that is hinged to the part of the closure on the container by an integral hinge. Conventionally, such closures rely on tension on the hinge to produce a snap action. Typical constructions are shown in U.S. Pat. Nos. 3,628,215, 3,629,901, 3,933,271, 4,047,495, 4,386,714.

Among the objectives of the present invention are to provide a dispensing closure which has a cap that operates with a snap action in moving to and from a closed position; which has minimum hinge protrusion so that it is compatible with high speed filling lines thus allowing greater line speeds; which provides a low profile; which is relatively easier to manufacture; which can be operated by one hand; which has an easy opening pour spout; wherein the spout is self-cleaning and provides a moisture seal.

In accordance with the invention, the closure with a snap type hinge cap comprises a first part adapted to interengage with the open neck of a container, a second part forming a cap and an integral hinge interconnecting the first and second parts. Each of the first and second parts comprises a base wall and a peripheral skirt. A pair of hinge straps extends from the skirts and are positioned on opposite sides of the integral hinge. The radial length of the pair of hinge straps is less than the length of the arc through which the second cap part moves to and from and closed position relative to the first part such that the pair of straps stretch to function as springs. The ends of the pair of straps are attached to the skirts radially inwardly of the periphery of the skirts.

In addition, a preferred form of the invention provides tight seal and spout cleansing features in a closure that is used in a product dispenser. The first part of the closure includes an axial spout extending outwardly therefrom on the top base wall of said first part. The end of the spout is chamfered inwardly. The second part or cap also has a top wall integral with a skirt. On the undersurface of the base wall of the cap are two concentric circular walls spaced apart approximately an amount equal to the wall thickness of the rim end of the spout. The concentric walls are positioned to align with and receive and seal the rim of the spout when the cap is closed. This interrelation provides (1) a tight seal of the spout opening when the cap is closed, and (2) cleansing the spout by having the inner of the concentric walls extending into the spout opening cleansing the spout of product at the top region of the spout each time the cap is closed.

DESCRIPTION

Figure 1:
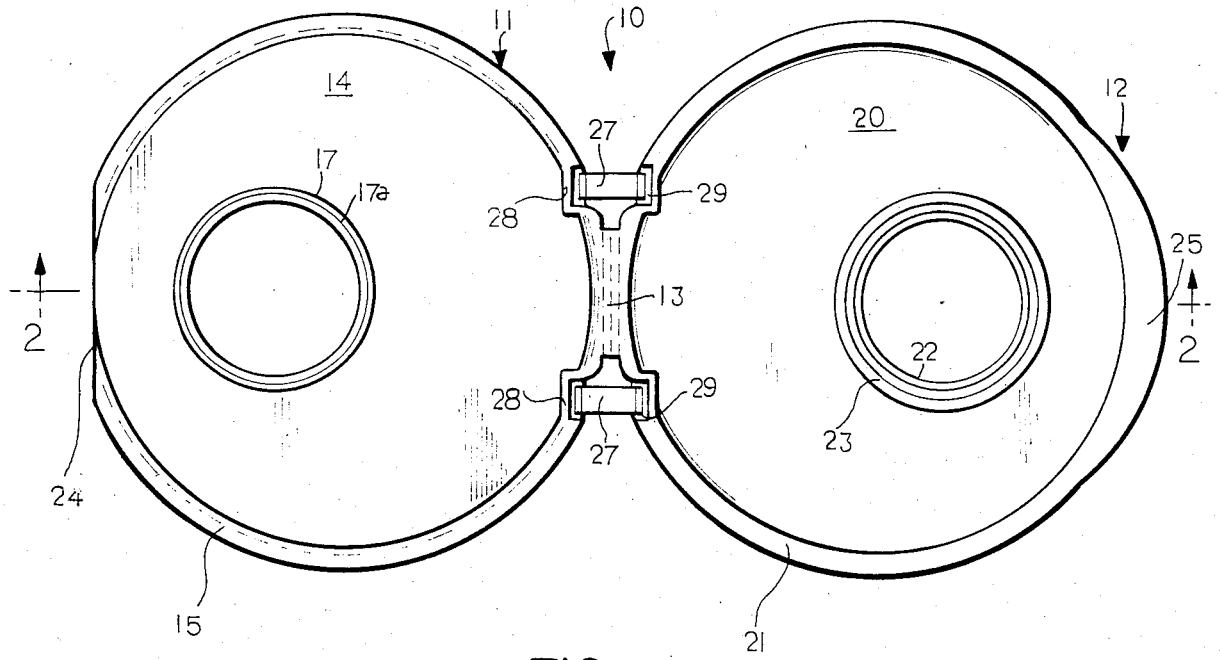
FIG. 1 is a plan view of a closure embodying the invention.
Figure 2:
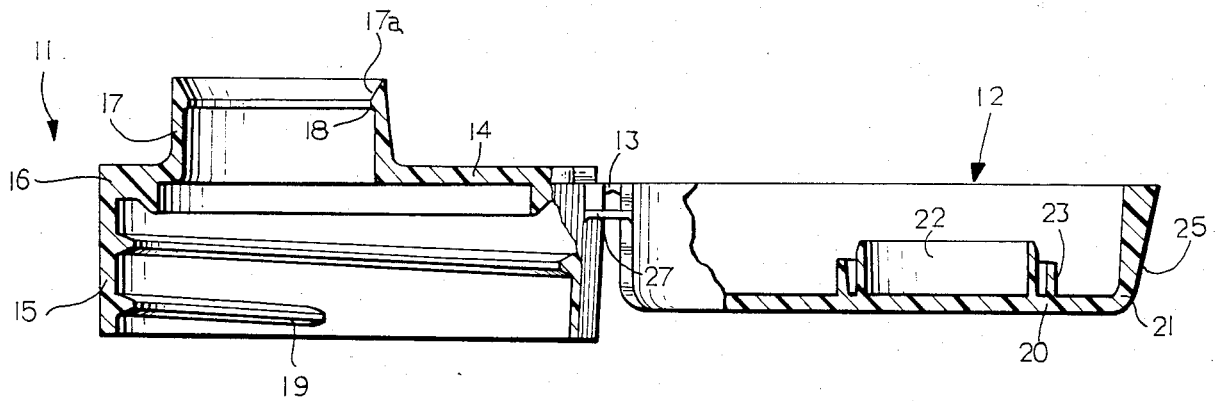
FIG. 2 is a sectional view taken along the line 2—2 in FIG. 1.
Figure 3:
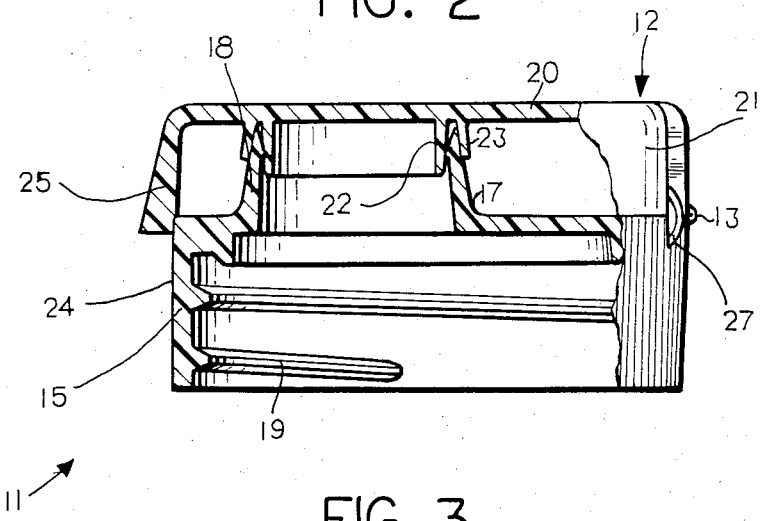
FIG. 3 is a view similar to FIG. 2 showing the cap portion of the closure in closed position.

Referring to the drawings, the closure 10 embodying the invention is made of plastic such as polypropylene and comprises a first part 11 which is adapted to be threaded on the neck of a container, a second part 12 which forms a cap and an integral hinge 13 connecting the first part 11 and second part 12.

The first part includes a base wall 14 and a peripheral skirt 15 with a shoulder 16 at the juncture of the base wall 14 and skirt 15. A tubular spout 17 extends from the exterior surface of base wall 14 and terminates in a chamfer rim 17*a*. An annular bead 18 is formed on the inner surface of the spout 17. The skirt 15 is formed with a thread on the inner surface thereof for engagement with the threads on the neck of a container. The spout 17 provides a dispensing outlet for the contents of a container on which the closure is applied.

The second or cap part 12 is formed with a base wall 20 and a peripheral skirt 21. Shoulder 16 is adapted to be engaged by the free edge of the skirt 21. Spaced concentric walls 22, 23 are provided on the inner surface of the base wall 20 and are adapted to telescope over the spout 17 and receive the rim 17*a* in the annular space formed between walls 22, 23 when the cap is moved to closed position. The wall 22 is axially shorter than the wall 23 to permit the swinging movement of the cap 12 into position for engagement of the wall 22 with the spout 17. Chamfer rim 17*a* guides the inner wall 22 into the opening of the spout 17. The inner diameter of the outer wall 23 is slightly less than the outer diameter of the spout 17 near the rim 17*a* such that the wall 23 engages and seals against the outer surface of the spout 17. Rib 18 provides a friction fit for innermost wall 22 to both insure a tight seal for the contents of the container and clean the spout of contents in the region adjacent rim 17*a*. The friction fit also secures the second part in closed position.

Peripheral skirt 15 of the first part 11 is formed with a flattened external surface 24 that underlies an enlarged radial portion 25 on the skirt 21 of the second part 12 so that the portion 25 can be engaged by the thumb of the user to open the closure. The enlarged portion 25 extends circumferentially and blends into the skirt 15 so that the cap part 12 is less likely to pop out and interfere with capping or case packing of the closed container.

Integral hinge 13 has a length several times its width to provide stability. The hinge 13 has its upper surface in the plane of the shoulder 16 and the free edge of the skirt 21. Hinge 13 extends from flat portions 21*a* and 15*a* of the skirts 21 and 15, respectively, so that the hinging action is about a straight line. The under side of the hinge 13 is in the form of an inverted V in radial cross section to define the hinge line at the apex of the V. A pair of hinge straps 27 is provided, one on each side of hinge 13. The length of the integral hinge 13 is several times the width of each of the straps 27.

Figure 4:
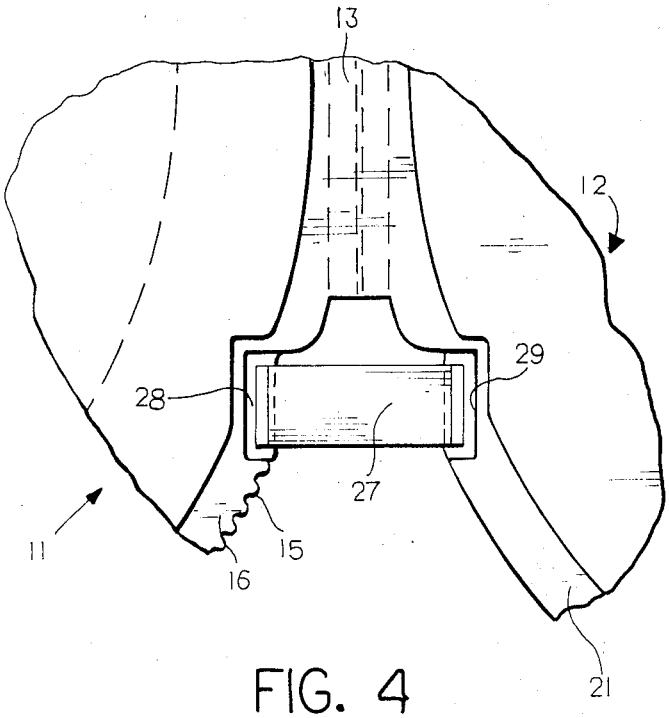
FIG. 4 is a fragmentary plan view on an enlarged scale of the hinge portion of the closure.
Figure 5:
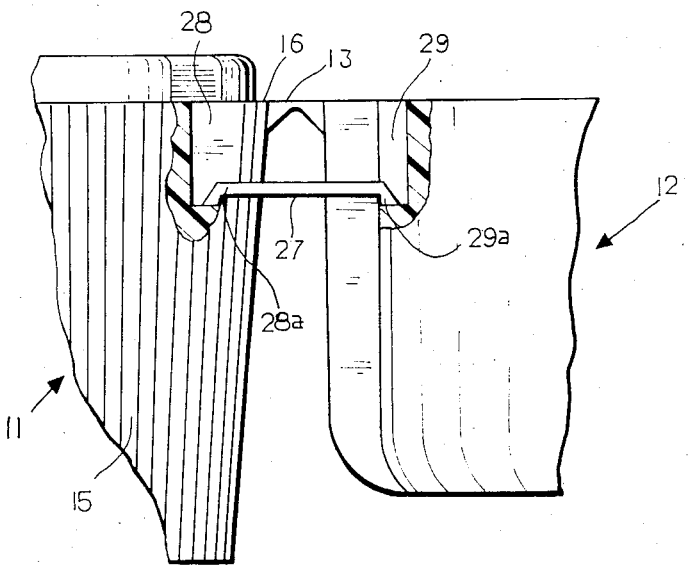
FIG. 5 is a fragmentary part sectional view on an enlarged scale of the hinge portion of the closure.
Figure 6:
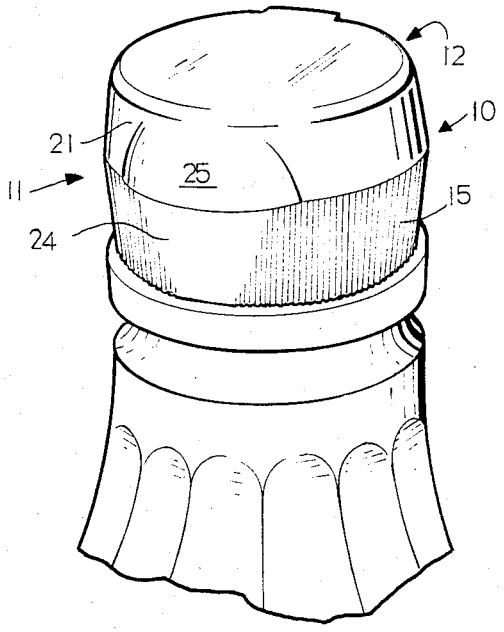
FIG. 6 is a fragmentary perspective view of the closure in closed position on a container.
Figure 7:
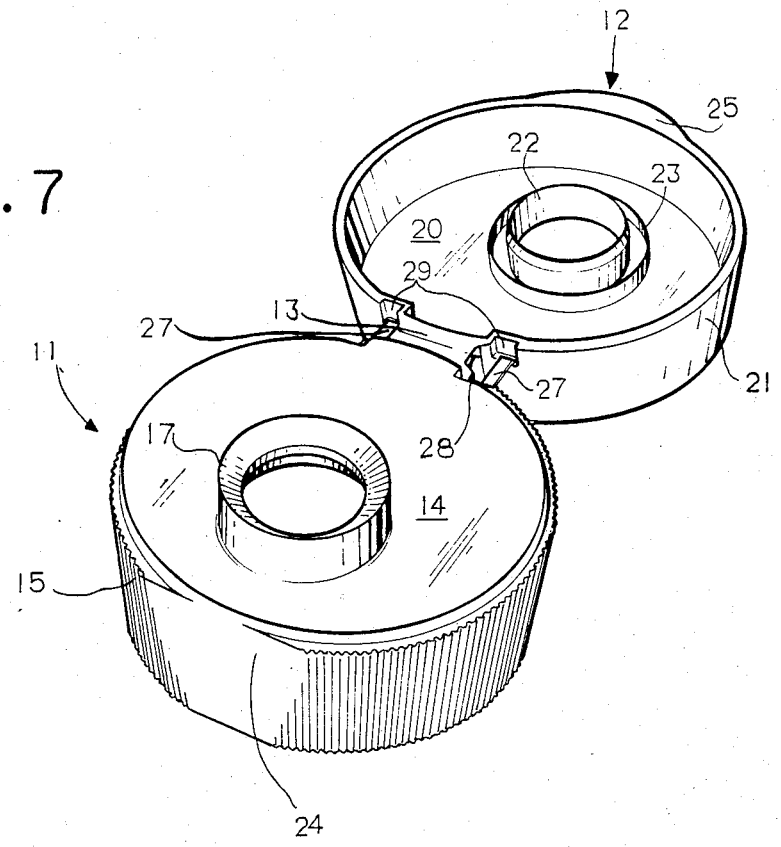
FIG. 7 is a fragmentary perspective view of the closure in open position.

Each strap extends between a recess 28 on part 11 and a recess 29 on part 12. The end of each strap 27 is connected to the base of the recesses 28, 29 by angular portions 28*a*, 29*a* which extend upwardly as viewed in FIG. 4 to lessen the profile of the straps 27 when the cap is in closed position.

By positioning the ends of the straps 27 in recesses, the protrusion of the straps beyond the periphery of the skirts of parts 11, 12 is minimized to facilitate capping and case packing.

The configuration of each strap 27 is such that the straps stretch in operation; i.e., in opening and closing part 12 on part 11.

We claim:

1. A closure with a snap type hinge cap comprising
a first part adapted to interengage with the open neck of a container,
a second part forming a cap and
an integral hinge interconnecting the first and second parts,
each of the first and second parts comprising a base wall and a peripheral skirt,
a pair of hinge straps extending from the skirts on opposite sides of the integral hinge,
the ends of the straps being positioned in recesses in said skirts,
said straps being substantially straight when said first part and second part are in open position,
said integral hinge having a flat top surface and an inverted V-shaped bottom surface.

2. The closure set forth in claim 1 wherein the portions of the skirt of the first part and second part to which the integral hinge is attached are flat in a circumferential direction.

3. The closure set forth in claim 2 wherein said straps are curved when said first part and second part are in closed position.

4. A closure with a snap type hinge cap comprising
a first part adapted to interengage with the open neck of a container,
a second part forming a cap and
an integral hinge interconnecting the first and second parts,
each of the first and second parts comprising a base wall and a peripheral skirt,
a pair of hinge straps extending from the skirts on opposite sides of the integral hinge,
said integral hinge and said straps being straight when said first part and second part are in open position,
said integral hinge having a flat top surface and an inverted V-shaped bottom surface.

5. The closure set forth in claim 4 wherein said straps are substantially straight when said first part and second part are in open position and are curved when said first part and second part are in closed position.

6. A closure with a snap type hinge cap comprising
a first part adapted to interengage with the open neck of a container,
a second part forming a cap and
an integral hinge interconnecting the first and second parts,
each of the first and second parts comprising a base wall and a peripheral skirt,
a pair of hinge straps extending from the skirts on opposite sides of the integral hinge,
the ends of the straps being positioned in recesses in said skirts,
the portions of the skirt of the first part and second part to which the integral hinge is attached being flat in a circumferential direction.

7. The closure set forth in claim 6 wherein said straps are substantially straight when said first part and second part are in open position and are curved when said first part and second part are in closed position.

8. The closure set forth in claim 7 wherein said integral hinge has a flat top surface and an inverted V-shaped bottom surface.

* * * * *